US005756022A

United States Patent [19]

Siegel et al.

[11] Patent Number: 5,756,022

[45] Date of Patent: May 26, 1998

[54] METHOD FOR FORMING A FOAMED INNERSPRING UNIT

[75] Inventors: Edmond Siegel, 4332 Weston Pl., Jamestown, N.C. 27282; Nolan D. Gamble, 3417 Winfin Way, Carmichael, Calif. 95608; Giovanni Monchiero, Arese, Italy

[73] Assignees: Edmond Siegel, Jamestown, N.C.; Nolan D. Gamble, Carmichael, Calif.; Tec Mac S.r.l, Galliate, Italy; a part interest

[21] Appl. No.: 213,002

[22] Filed: Mar. 15, 1994

[30] Foreign Application Priority Data

Feb. 4, 1994 [IT] Italy ..... MI94A0210

[51] Int. Cl.[6] ..... B29C 44/06; B29C 44/12

[52] U.S. Cl. ..... 264/46.7; 264/46.4; 264/46.5; 264/271.1; 264/278; 264/338

[58] Field of Search ..... 264/338, 46.7, 264/46.4, 278, 271.1

[56] References Cited

U.S. PATENT DOCUMENTS

| | | | |
|---|---|---|---|
| Re. 24,914 | 12/1960 | Koenigsberg . | |
| 252,973 | 1/1882 | Schenk | 5/465 |
| 1,528,066 | 3/1925 | McEntire | 5/465 |
| 2,698,444 | 1/1955 | Piliero . | |
| 2,994,890 | 8/1961 | Wagner | 264/46.7 |
| 3,005,213 | 10/1961 | Brown et al. . | |
| 3,049,730 | 8/1962 | Wall et al. . | |
| 3,069,701 | 12/1962 | McInerney . | |
| 3,081,487 | 3/1963 | Heffner et al. . | |
| 3,099,021 | 7/1963 | Wetzler | 264/46.7 |
| 3,116,196 | 12/1963 | Terry | 264/46.7 |
| 3,204,016 | 8/1965 | Sanger et al. | 264/46.7 |
| 3,216,849 | 11/1965 | Jacobs . | |
| 3,239,584 | 3/1966 | Terry et al. . | |
| 3,325,834 | 6/1967 | Lovette et al. . | |
| 3,452,127 | 6/1969 | Lovette et al. . | |
| 3,480,703 | 11/1969 | Moritz et al. | 264/46.7 |
| 3,719,963 | 3/1973 | Bulloch . | |
| 3,821,823 | 7/1974 | Krier et al. . | |
| 3,855,653 | 12/1974 | Stalter et al. . | |
| 3,920,609 | 11/1975 | Lehmann . | |
| 3,981,033 | 9/1976 | Toda . | |
| 4,003,113 | 1/1977 | Bulloch, Jr. | 264/46.7 |
| 4,004,305 | 1/1977 | Rubin | 5/464 |
| 4,073,839 | 2/1978 | Burkholder et al. . | |
| 4,116,735 | 9/1978 | Plasse . | |
| 4,213,214 | 7/1980 | Gilhooly | 5/481 |
| 4,221,877 | 9/1980 | Cuscurida et al. . | |
| 4,251,639 | 2/1981 | Jerre et al. . | |
| 4,544,126 | 10/1985 | Melchert | 264/46.7 |
| 4,811,439 | 3/1989 | Siegel et al. | 5/47.5 |
| 4,956,884 | 9/1990 | Hwang | 5/477 |
| 5,069,837 | 12/1991 | Sember, III et al. | 264/278 |

FOREIGN PATENT DOCUMENTS

| | | | |
|---|---|---|---|
| 221200 | 9/1957 | Australia | 5/477 |
| 249912 | 3/1982 | Austria | 5/475 |
| 76 18184 | 6/1978 | France . | |
| 496225 | 12/1954 | Italy | 5/478 |
| 758078 | 9/1956 | United Kingdom | 5/352 |
| 994021 | 6/1965 | United Kingdom . | |
| 2 304 985 | 8/1974 | United Kingdom . | |

*Primary Examiner*—Allan R. Kuhns
*Attorney, Agent, or Firm*—Siroock & Siroock & Lavan LLP

[57] ABSTRACT

A method for forming a foamed innerspring unit is provided including releasably securing a plurality of coils to a jig, delivering a foamable reaction mixture to a tray and positioning the jig so that the ends of the coils extending away from the jig are spaced from the bottom of the tray so that the rising foam embeds the end of the coil. The process is repeated by releasing the foamed layer embedding one end of the coils, releasably holding the first foam layer with the ends thereof spaced from a tray having said foamable reaction mixture therein so that the second end of the coils is embedded a second foam layer. A mattress formed of a plurality of innerspring unit sections formed in accordance with the foregoing may be combined within a cover to define a mattress. By selecting the firmness of the coils of adjacent sections, regions of differing firmness can be provided in the mattress.

25 Claims, 5 Drawing Sheets

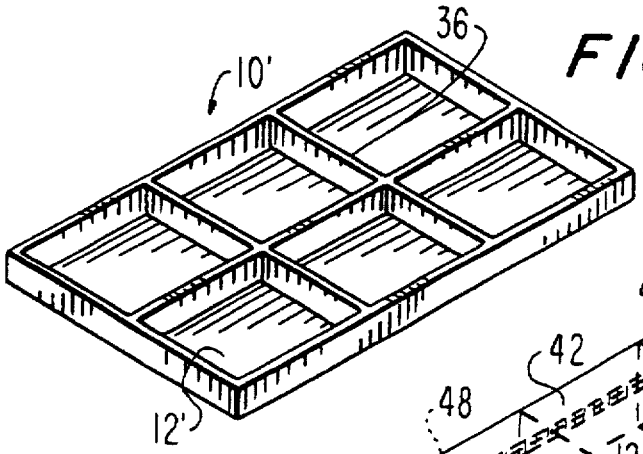
FIG. 10
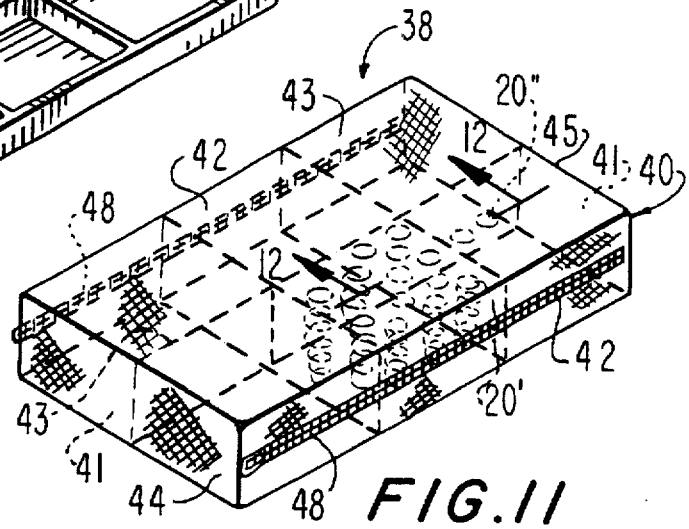
FIG. 11
FIG. 12
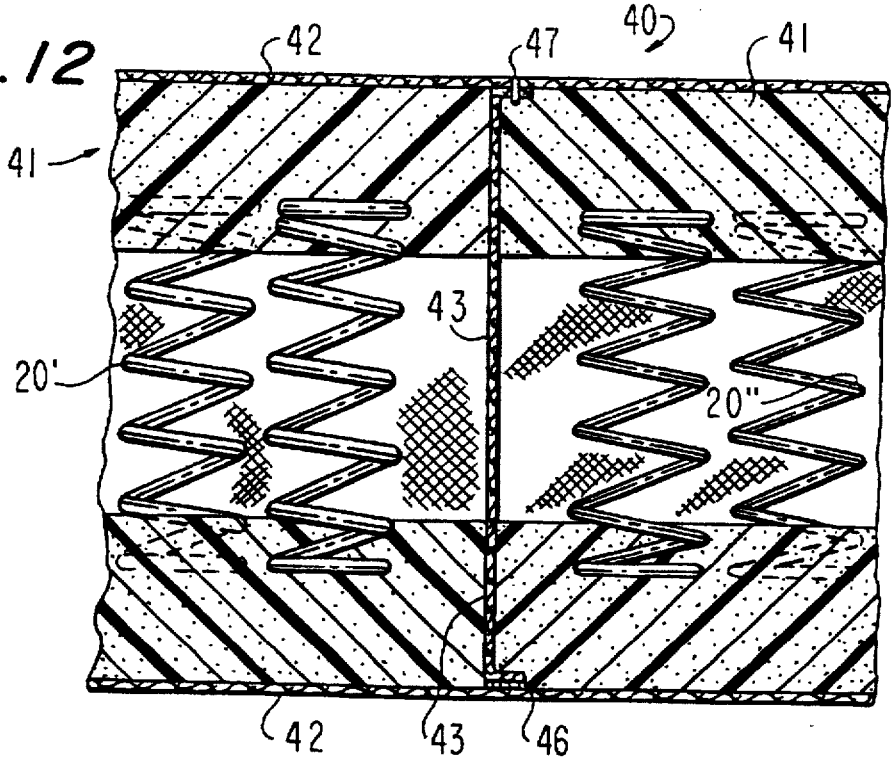

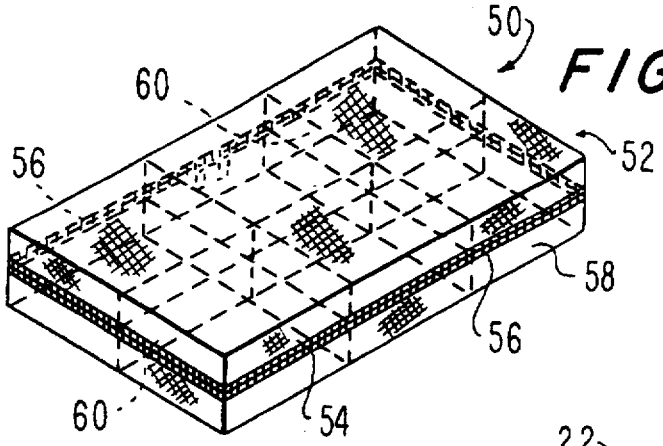
FIG. 13
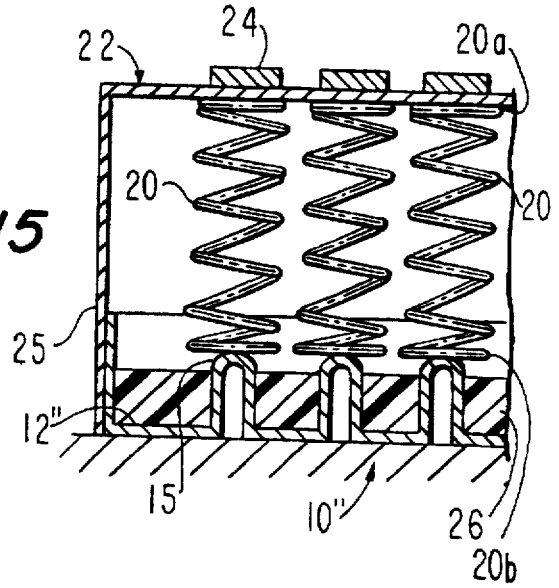
FIG. 15
FIG. 16
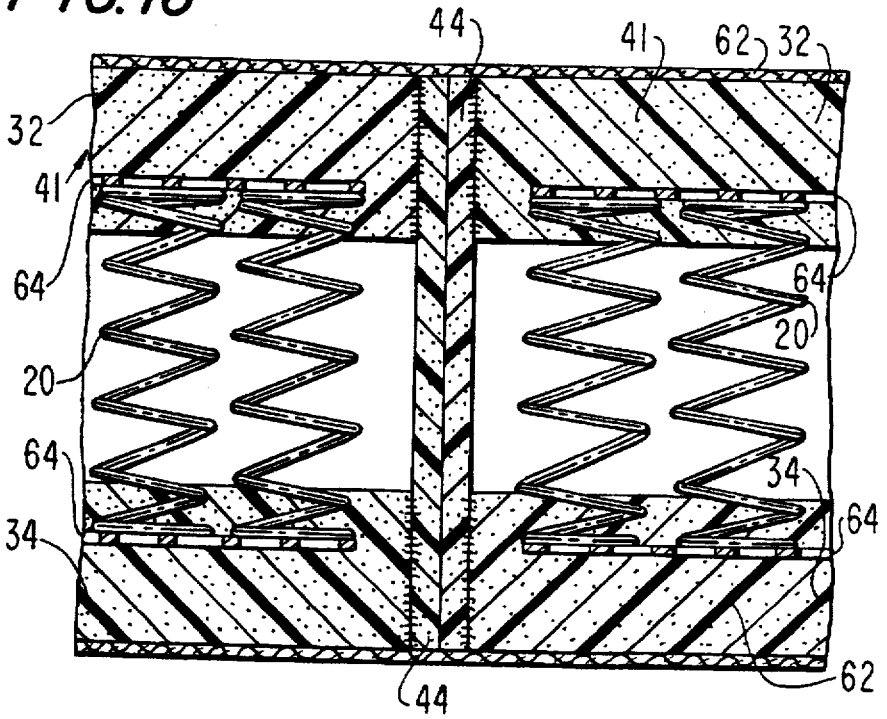

METHOD FOR FORMING A FOAMED INNERSPRING UNIT

BACKGROUND OF THE INVENTION

The present invention relates to foamed innerspring units and, in particular, to a method of manufacturing foamed innerspring units wherein a flexible polyurethane foam is adhered directly to the innerspring and wherein adjacent springs are free of any supporting connection between each other other than the foam.

As used herein, the term "foamed innerspring unit" is intended to be construed in its broadest sense. In general, such foamed innerspring units include mattresses and box springs. A mattress is designed to provide support for a person sleeping thereon, while a box spring provides support for both the mattress and the person sleeping on the mattress. However, other types of "foamed innerspring units" such as cushions, car seats and the like can be provided in accordance with the invention and the term "foamed innerspring unit" is not intended to be limited only to mattresses and box springs.

Innerspring units formed of a unitary construction are known. U.S. Pat. No. 4,811,439 (the U.S. Pat. No. '439) issued to the inventors of this application on Mar. 14, 1989, discloses a method of producing a foamed innerspring unit in a discontinuous process using a foamable reaction mixture of at least diphenylmethane diisocyanate and a polyol. The process comprises the steps of: spraying the foamable reaction mixture into the bottom of a mold cavity or tray; loading an innerspring unit, which unit has interconnected coils, into the tray which has the foamable reaction mixture in it; and permitting the foamable reaction mixture to rise to form a foam and adhere to the interconnected coils of the innerspring unit. A release agent is preferably applied to the try before spraying the foamable reaction mixture into the tray, and the foam is preferably cured before the tray is emptied and cleaned.

The innerspring unit loaded into the foamable reaction mixture of the U.S. Pat. No. '439 is an innerspring unit well known in the art since the coils of the innerspring unit, which is later exposed to the unique foaming process, are all interconnected with each other.

Heretofore, innerspring units have been produced having coils which are interconnected with each other. Innerspring units are constructed by a variety of methods, all designed to form the individual coils into an assembly of coils of a prescribed shape and coil count. The coils are usually held together by spirals of wire known as "pigtails", clamped together by lengths of wire, or encapsulated into pockets of fabric forming long strips which are then attached to one another by sewing, gluing or hog ringing.

Accordingly, the method of forming a foamed innerspring unit has been limited to use of an innerspring unit wherein the coils of the innerspring were securely bound to each other prior to exposure to a foaming process, which innerspring units inhibit flexibility in mattress design and increase the cost of mattresses. By forming a foamed innerspring unit by embedding the ends of the individual coils directly into a foaming material so that each coil within the innerspring unit is free of any interconnection between adjacent coils other than by the foam for determining the relative position of the coils, an improved mattress production results and improved mattress can be produced.

SUMMARY OF THE INVENTION

Generally speaking, in accordance with the instant invention, a method for producing a foamed innerspring unit in a discontinuous process wherein the coils of the innerspring unit are embedded into the surface of the foam so that adjacent coils are free of any supporting interconnection other than the foam, is provided. The process comprises releasably mounting individual coils by their respective first ends onto a first jig, placing the first jig over a tray which contains the foamable reaction mixture so that the free second ends of the coils are suspended spaced from the bottom of the tray, and allowing the foamable reaction mixture to rise so that the second ends of the individual coils become embedded in the foam, separating the first jig from the first end of the coils and curing the foam or permitting the foam to cure. The method can include the further steps of spraying a releasing agent into a tray before applying the foam and applying the foam by spraying.

The method can also include the further steps of removing the foam member which has the second ends of the coils embedded within it from the tray, releasably mounting the foam member onto a second jig with the free first ends of the coils projecting therefrom, positioning the second jig over a tray containing a foamable reaction mixture with the free first ends of the coils spaced from the bottom of the tray and allowing the foamable reaction mixture to rise so that the first ends of the individual coils become embedded into the foam. The method can still further include removing the second jig, curing the foam or permitting the foam to cure and removing the completed foamed innerspring unit from the tray.

A foamed innerspring unit having a plurality of coils, adjacent coils being joined for relative positioning at each of their respective ends only by a layer of foam adhered to the coil ends, is also provided. A foamed innerspring unit section formed of a plurality of coils, adjacent coils being joined for relative positioning at each of their ends only by a layer of foam adhered to the coil ends, may be provided, permitting the construction of a mattress by assembling at least two of such mattress sections by a retaining means. The retaining means may include a mattress cover overlying and joining the mattress sections. The interior of the mattress cover may be compartmentalized to receive one or more mattress sections. The mattress sections or regions of a unitary foamed innerspring unit can be selected to have different degrees of firmness as by selection of the coils in each section or region.

Accordingly, it is an object of the invention to provide a method of manufacturing a foamed innerspring unit in a discontinuous process using a foamable reaction mixture to form an innerspring unit having adjacent coils free of any connection controlling their relative positioning other than the foam at their ends.

A further object of the invention is to provide a method of manufacturing a foamed innerspring unit at low cost.

Another object of the invention is to improve the comfort of foamed innerspring units.

Another object of the invention is to provide orthopedic qualities to the foamed innerspring unit.

Another object of the invention is to provide an inexpensive, comfortable and safe foamed innerspring unit.

A further object of the invention is to provide a foamed innerspring unit composed of a plurality of foamed innerspring sections to permit customizing the firmness of various locations in the mattress.

Still other objects and advantages of the invention will be apparent from the specification.

The invention accordingly comprises the several steps and the relation of one or more of such steps with respect to each of the others, and the articles possessing the features, properties and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 10 is a perspective view of an alternate embodiment of the tray in accordance with the invention having partitions dividing the tray into six sections;

FIG. 11 is a perspective view of a foamed innerspring mattress made from the six foamed innerspring components in accordance with the invention and a partitioned mattress cover;

FIG. 12 is an enlarged fragmentary cross-sectional view of the foamed innerspring components taken through line 12—12 of FIG. 11;

FIG. 13 is a perspective view of a cover of an alternate embodiment of a mattress in accordance with the invention having six innerspring components in an alternate embodiment of a partitioned mattress cover;

FIG. 15 is a fragmentary cross-sectional view of the embodiment of the first jig placed upon the alternate embodiment of the tray of FIG. 14 having notches or ridges to support the ends of the coils; and FIG. 16 is an enlarged fragmentary cross-sectional view showing an alternate embodiment of a multi-section mattress in accordance with the invention having a cover without internal partitions.

DETAILED DESCRIPTION OF THE INVENTION

Figure 1:
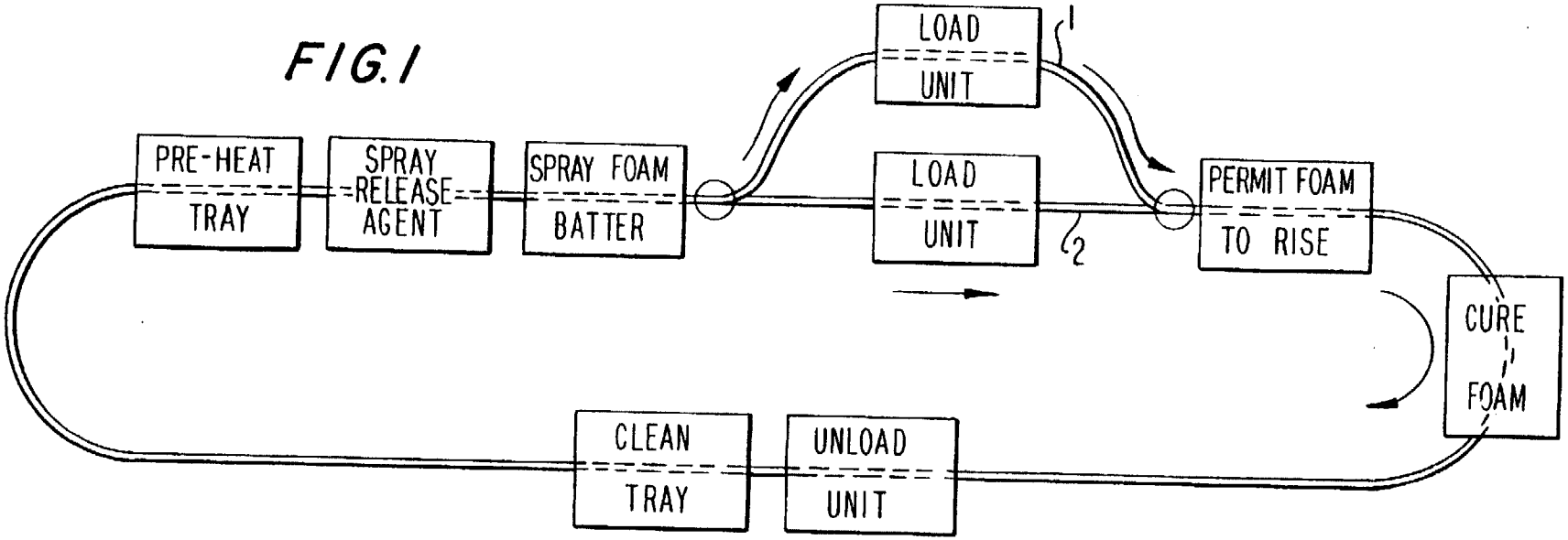
FIG. 1 is a flow diagram showing the steps of one embodiment of the method of the invention.

An example of the basic process for forming a foamed innerspring unit using the known innerspring units having interconnected coils is disclosed in the U.S. Pat. No. '439 patent which is incorporated herein by reference as if -fully repeated herein. Reference is made to FIG. 1, wherein the process of the U.S. Pat. No. '439 patent is generally indicated, except that after the "spray foam batter" step a parallel conveyor 1 is provided by way of example in accordance with the present invention to perform specific loading steps so that an innerspring having a plurality of coils, adjacent coils being free of all interconnection for relative positioning other than the foam at their ends, is manufactured. Main conveyor 2 can perform the process of the U.S. Pat. No. '439 patent when the load unit step is performed suing a conventional spring assembly with adjacent springs joined to each other. The method can comprise the steps of: releasably mounting individual coils by their respective first ends onto a first jig; spraying a release agent into a tray; spraying a foamable reaction mixture, preferably but not necessarily formed from at least diphenylmethane diisocyanate and a polyol, that will provide a flexible foam into the tray; positioning the first jig, having the coils individually mounted by their first ends, over the tray which contains the foamable reaction mixture so that the second ends of the individual coils are suspended spaced from the bottom of the tray; permitting the foamable reaction mixture to rise to form a flexible foam adhered to the second ends of the coils; separating the first jig from the first ends of the coils; curing the foam or permitting the foam to cure; removing the foam member having the second ends of the coils embedded therein from the tray; releasably mounting the foam member having the second ends of the coils embedded therein onto a second jig; positioning the second jig over a tray containing a foamable reaction mixture so that the free first ends of the coils are suspended spaced from the bottom of the tray; permitting the foamable reaction mixture to rise to form a flexible foam adhered to the first ends of the coils; separating the second jig from the foam member; curing the foam or permitting the foam to cure; and removing the second foam member having the first ends of the coils embedded therein from the tray.

Referring to FIG. 1, the process of this invention can be used in conjunction with or in the alternative to the process disclosed in the U.S. Pat. No. '439 patent. A diverging second conveyor belt is depicted to perform the unique steps of the present invention, including releasably mounting the jigs with the coils or the partial innerspring unit and positioning jigs over a tray having a foamable reaction mixture therein. The second conveyor belt may then rejoin the main conveyor belt to complete the process as disclosed in the U.S. Pat. No. '439 patent. This arrangement permits innerspring units free of any interconnections between adjacent coils other than the foam and innerspring units as taught in the U.S. Pat. No. '439 patent having conventional innersprings where the coils are bound to each other to be reproduced alternatively on the same production line.

Alternatively, the process of this invention is also well suited to having its own "permit foam to rise", "cure foam" "unload unit" and "clean tray" stations so that innerspring units having coils free of any interconnection between adjacent coils other than the foam can be produced on a single conveyor. Even where only a single conveyor is provided, provision can be made to produce both types of mattresses on the single conveyor. One advantage of the method in accordance with the invention is that the method can be applied on a discontinuous basis. Thus, the application of the second foam layer to the coils can occur at any time.

Referring to FIG. 1, the basic process in accordance with the U.S. Pat. No. '439 patent may be performed on a conveyor arrangement shown schematically with various steps performed at various locations along the conveyor arrangement. The first step of FIG. 1, pre-heating the tray, is an optional step preferably used where the tray is formed of a metal such as steel. However, the tray is preferably formed of polyethylene, in which case, the pre-heating step may not be required.

Figure 3:
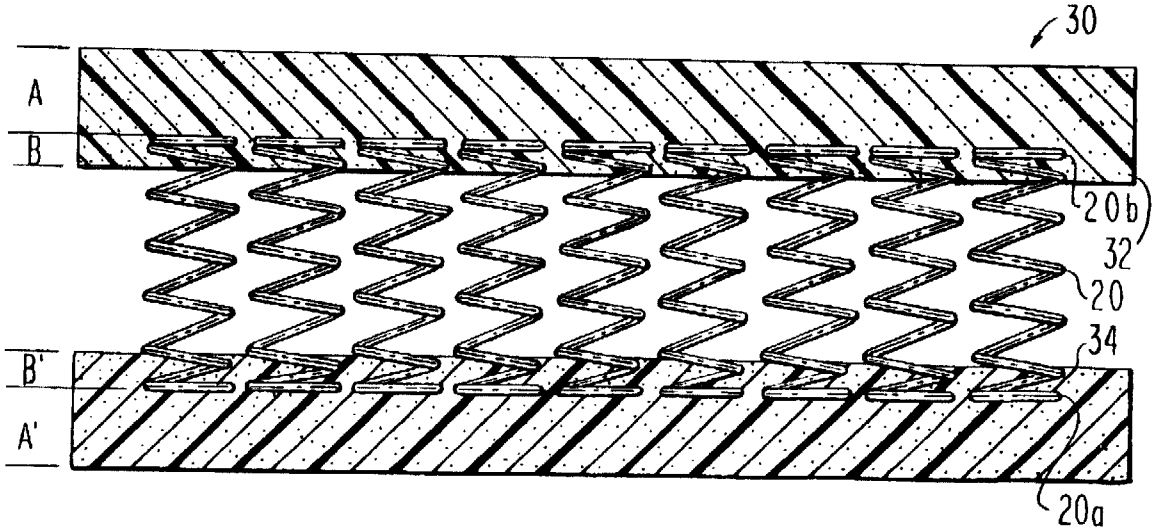
FIG. 3 is a cross-sectional view of the foamed innerspring unit taken through line 3—3 of FIG. 2.
Figure 2:
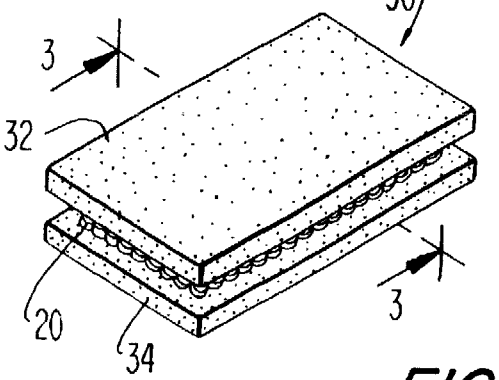
FIG. 2 is a perspective view of a foamed innerspring unit prepared in accordance with the invention.

Referring to FIGS. 2 and 3, the process in accordance with the invention produces an innerspring unit 30 having a plurality of coils 20 connected to each other only by the two foam members 32 and 34, which capture and are secured to the respective ends of the springs in the region B of foam member 32 and B' of foam member 34. The height of the regions A of foam member 32 and A' of foam member 34 can be as thin as one-quarter to three-eighth inch above the height of the coil ends.

In the spray release agent step, the tray is sprayed with a suitable release agent. Suitable release agents generally encompass long chain waxes dissolved in solvents. In particular, such agents include, but are not limited to, CHEM-TREND PRC 778 Registered ™ manufactured by Park Chemical Co., CHEM-TREND CT 1081 Registered ™ and CHEM-TREND CT 1057 Registered ™, all manufactured by Chem Trend Corporation and HR 29 Registered ™ manufactured by Green Chem Products.

Once the tray has been preheated (if necessary) and sprayed with a release agent, it is ready to receive a foamable reaction mixture. The foamable reaction mixture used in accordance with the invention is prepared using diphenylmethane diisocyanate and at least one polyol without preparation of a prepolymer.

In general, the isocyanate is a blend of 2,4'-diphenylmethane diisocyanate and 4,4'-diphenylmethane diisocyanate. The isocyanates are present in an amount of greater than about 80% 4,4'-diphenylmethane diisocyanate and less than about 20% 2,4'-diphenylmethane diisocyanate. In an especially preferred embodiment, the blend includes greater than about 90% 4,4'-diphenylmethane diisocyanate and less than about 10% 2,4'-diphenylmethane diisocyanate.

The average isocyanate functionality refers to the average number of NCO groups attached to each molecule. In a preferred embodiment, the isocyanate functionality is between about 2 and 2.8. More preferably, the isocyanate functionality is between about 2.1 and 2.3.

The isocyanate equivalent weight refers to the molecular weight of an isocyanate molecule divided by the average isocyanate functionality. In a preferred embodiment, the isocyanate equivalent weight is between about 130 and 135.

Furthermore, in a preferred embodiment, the viscosity of the isocyanate mixture is between about 35 and 100 centipoises at 20° C. This low viscosity is desirable for purposes of the invention.

The polyol is a hydroxyl terminated copolymer. In a preferred embodiment, the polyol copolymer contains between about 14% and 20% ethylene oxide or propylene oxide and between about 80% and 86% of a polyether having a molecular weight of between about 4,000 and 6,000.

A blowing agent such as water which reacts with the isocyanate mixture and provides carbon dioxide is required to foam the reaction mixture and this should be provided.

Catalysts which accelerate the polyurethane formation and, optionally, auxiliaries and additives, which are commonly used for the manufacture of flexible polyurethane foam, can also be added to the foamable reaction mixture. Auxiliaries and additives include, for example, surface-active materials, flame inhibitors, pore regulators, antioxidants, hydrolysis-protection agents, dyes, fillers and other additives.

Suitable catalysts for accelerating the reaction between the polyols, the water, and optional chain-extension agents, on the one hand and the polyisocyanate mixture, on the other hand, include tertiary amines such as dimethylbenzylamine, N,N,N',N'-tetramethyldiaminodiethyl ether, bis-(dimethylaminopropy)-urea, N-methyl- or N-ethylmorpholine, dimethylpiperazine, 1,2-dimethylimidazole, 1-aza-bicyclo-(3,3,0)-octane, and preferably, triethylenediamine, metal salts such as lead octoate, tin, di-2-ethylhexanoate, and preferably, tin-(II) salts, and dibutyltin dilaurate, as well as, particularly, mixtures of tertiary amines and organic tin salts.

Preferably used are 0.5 to 5 percent by weight catalyst based on tertiary amines and/or 0.01 to 2.5 percent by weight of metal salts, based on the polyol weight.

Other possible materials to be used include surface-active substances which support the homogenization of the raw materials and which are also suited to regulate the cell structure of the flexible polyurethane foams. To be mentioned as examples are siloxaneoxyalkylene mixed polymer and other organic polysiloxanes oxyethylated alkylphenol, oxyethylated fatty alcohols, paraffin oils, castor oil or ricinoleic ester, and turkey red oil, which are used in quantities of 0.2 to 6 parts by weight per 100 parts by weight of the polyisocyanate mixture.

In order to improve the flame resistance, flame inhibitors can be added to the flexible polyurethane foams manufactured in accordance with this invention. To be mentioned as examples are compounds containing phosphorus and/or halogen atoms which can also reduce the tendency toward brittleness of the products and function as plasticizers. These include tricresyl phosphate, tris-2-chloroethyl phosphate, tris-chloropropyl phosphate and tris-2,3-dibromopropyl phosphate, inorganic flame inhibitors such as antimony trioxide, arsenic oxide, ammonium phosphate, ammonium sulfate, and others, and preferably, cyanic acid derivatives such as cyanamide, dicyandiamide, guanidine, and in particular, guanidine salts, biguanidine, and particularly, melamine. It has generally proven to be advantageous to use 5 to 70 parts by weight, preferably 10 to 50 parts by weight, of the above-referenced flame inhibitors per 100 parts by weight of the isocyanate mixture.

More detailed data concerning the above-mentioned other commonly used auxiliaries and additives are described in the literature, such as the monograph by J. H. Saunders and K. C. Frisch, "High Polymers", Volume XVI, Polyurethanes, Parts 1 and 2, Interscience Publishers, 1962 and 1964.

The polyol and the isocyanate are mixed in one step using suitable spray equipment. One example of suitable spray equipment is the Gusmer automatic mechanically self-cleaning high pressure spray gun. In particular, a model GX7 gun manufactured by Gusmer Corporation of Lakewood, N.J. is suitable. The spray gun has two inlet ports, a mixing chamber and an outlet. One of the inlet ports is adapted to receive the polyol while the other is adapted to receive the isocyanate. A high pressure proportioner such as the model H-2000 high pressure proportioner also manufactured by Gusmer Corporation can be used to adjust the ratio of polyol to isocyanate entering the inlet ports. The polyol and isocyanate are mixed rapidly in the mixing chamber to form a foamable reaction mixture. The foamable reaction mixture is dispensed through the outlet in an appropriate pattern prior to the time the reaction mixture begins to foam.

The spray equipment used to carry out the method of the invention is commonly used in the construction industry for manufacturing and spraying rigid foams, roof insulation, thin layer coatings and the like. The equipment is relatively inexpensive, portable, easy to handle and transport and mixes the components of the spray under high pressure. However, only one setting is available for each gun. Conventional high or low pressure mixing equipment for mixing flexible foams generally have variable settings so that the isocyanate equivalent weight can be adjusted as necessary by changing the pump speed.

The spray equipment used to carry out the process of the invention places limitations on the chemistry. Usually, MDI chemistry proceeds using about a 1:1 ratio of isocyanate-:polyol. However, in order to prevent clogging of the spray gun due to premature foaming, it is necessary to adjust the ratio to about 1 part isocyanate per 2 parts polyol.

The resulting foam has a density of between about 2.0 and 2.5 lbs/ft$^3$, preferably, between about 2.0 and 2.2 lbs/ft$^3$. In contrast, foam prepared using TDI chemistry has a density on the order of about 1.2 lbs/ft$^3$. A foam having a density of between about 2.0 and 2.5 lbs/ft$^3$ has about twice as much chemical composition per cubic foot of foam as a foam having a density of 1.2 lbs/ft$^3$ and, correspondingly, less air in the foam. Foams prepared in accordance with the invention are, therefore, attractive from the point of view of weight and cost. A foam having a density within the preferred range will provide a firm and comfortable mattress. Additionally, foams prepared using MDI chemistry do not have tough, inflexible skins on the side adjacent the tray.

A dense foam of the type prepared in accordance with the invention will return to its original configuration or, at the least, nearly its original configuration after it has been compressed and the compression force has been withdrawn, i.e. the foam exhibits elastic deformation. This is a desirable characteristic for a foam used to prepare a foamed innerspring unit. Less dense foams exhibit plastic deformation and this is undesirable.

Figure 5:
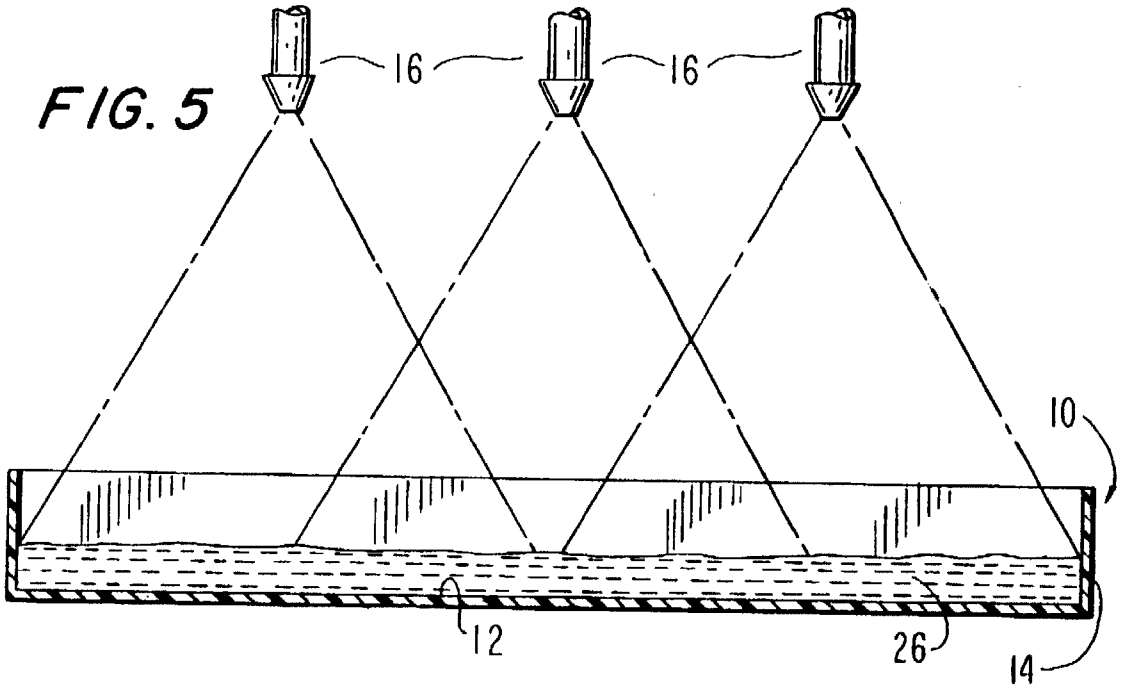
FIG. 5 is a cross-sectional view showing a foam spray used in the method of the invention as applied to the tray of FIG. 4.

The nozzle 16 of the specialized spray gun used in accordance with the invention sprays the foamable reaction mixture in a straight line fan pattern as shown in FIG. 5. The foamable reaction mixture is sprayed into the tray to an appropriate depth. The depth of spray is determined by the height that the foam is to be permitted to rise. In general, the foam rises to about five times the height to which it is sprayed. Alternatively, the spray pattern can be an oval pattern.

In a preferred embodiment, the fan spray has a width of 24 inches. Accordingly, the spray gun is traversed over the tray in order to fill the tray to the predetermined depth. In an alternate embodiment, multiple spray guns can be used and, in a still further alternate embodiment, the spray gun can be maintained stationary and the tray can be moved as necessary. It is to be noted that the most difficult area to cover are the edges of the tray and accordingly, an especially heavy spray is required in these areas. This may be achieved by having a portion of the foam pattern impact on the sidewalls of the tray as shown in FIG. 5.

Since the edge of a mattress is a weak spot, torsion bars are usually provided in conventional mattresses in order to provide additional edge support. The torsion bars are arranged so that four are provided on each side and one on each end. The present invention contemplates that the edges can be built up laterally with foam so as to form a solid wall. This will provide continuous peripheral edge support and obviate the need for torsion bars.

In a preferred embodiment, five passes of the spray gun are required for filling the tray for a queen size mattress to a depth of 3/16 inch thick of foamable reaction mixture. Additionally, 3/16 inch batter will approximately quadruple in volume to provide a ¾ inch thick layer of foam.

It is not necessary to provide excess amounts of foam. Only sufficient foam is necessary to form a thin layer above the springs. In addition, it is only necessary to provide enough foam in the springs to adhere the foam to the springs. Use of excess foam is not desirable from the point of view of materials or cost.

Figure 8:
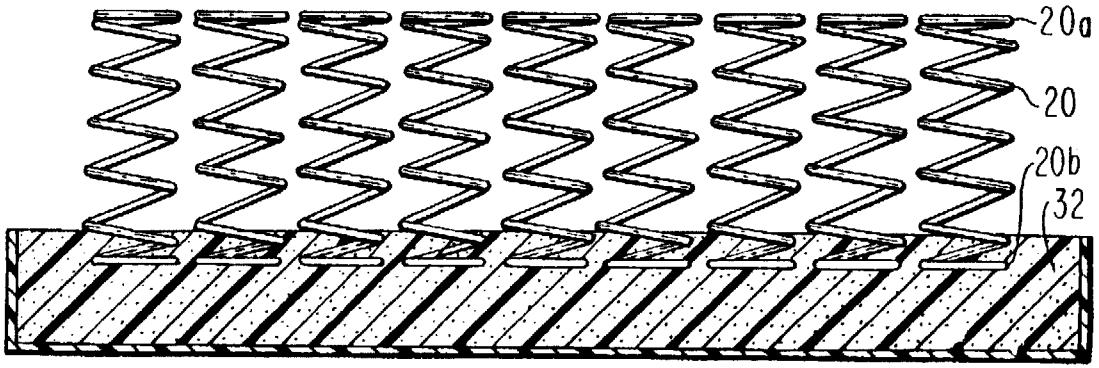
FIG. 8 is a cross-sectional view of a partially prepared foamed innerspring unit in accordance with the invention, showing the risen foam adhered to the second ends of the coils in the tray.
Figure 4:
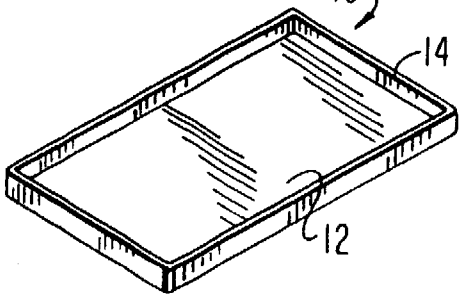
FIG. 4 is a perspective view of one embodiment of a tray used to prepare a foamed innerspring unit of the invention.

One embodiment of a tray or mold cavity 10 of the type adapted to be used to make foamed innerspring units in accordance with the invention is shown in FIG. 4 and in cross-section in FIGS. 5 and 8. The tray differs from the tray of the U.S. Pat. No. '439 in that the stops or notches for limiting insertion of the springs and guides for centering are dispensed with. The size and shape of the tray is not critical and is determined by the size and shape of the unit to be provided. In general, trays can be provided for any type of foamed innerspring unit such as mattresses, box springs, car seats, cushions and the like.

As shown in FIG. 4, tray 10 has a flat bottom 12 which defines a rectangular area. Four perpendicular side walls 14 define sides of tray 10. The preferred embodiment is to spray the foamable reaction mixture into tray 10 having a flat bottom 12 and position coils 20 above the foamable reaction mixture layer so that the foamable reaction mixture rises and captures the ends of the coils. In the alternative, the free ends of the coils can be inserted in the foamable reaction mixture as it rises and before it sets and is cured.

Figure 6:
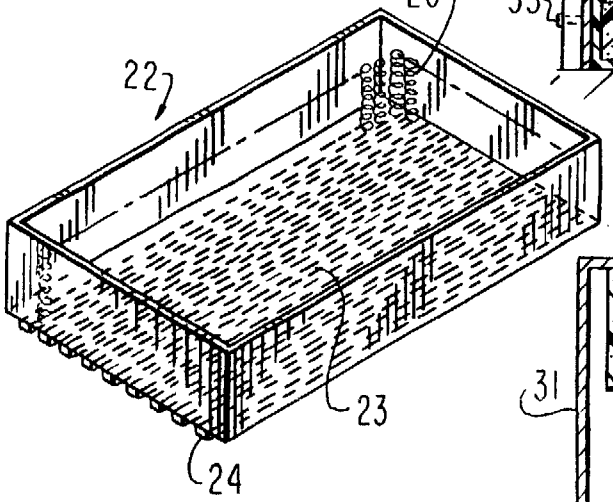
FIG. 6 is a perspective view of the interior of a first jig in accordance with the invention with the first ends of the coils being held by magnets therein.

In order to carry out the process of the invention, the coils 20 must first be releasably mounted on a first jig 22 as shown in FIG. 6, which has a horizontal wall 23 and side walls 25 depending perpendicularly from the horizontal wall 23. Jig 22 is formed of a metal which is magnetizable such as steel, and a plurality of permanent magnets 24 are secured to the outer surface of horizontal wall 23. A plurality of coils 20 are releasably held in prescribed positions on the inner surface of horizontal wall 23 in a desired pattern with a first end **20*a* of the coils 20 engaged against horizontal wall 23 and a second end 20*b* of the coils 20 being free and projecting into the space between side walls 25**.

Figure 7:
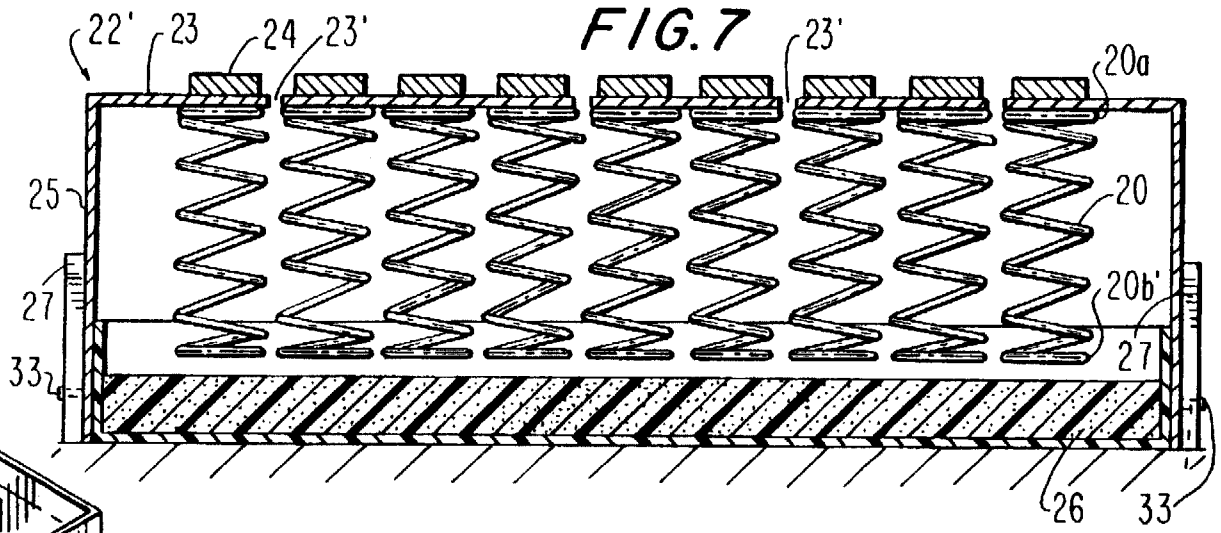
FIG. 7 is a cross-sectional view of an alternate embodiment of the jig of FIG. 6 showing the first ends of the coils held in place by magnets, with the jig placed over a tray having a foamable reaction mixture therein with the free second ends of the coils above said mixture.

Reference to FIG. 7 is made, wherein the jig 22' with the coils independently mounted on the inner surface of horizontal wall 23 is shown. First ends **20*a* of the coils 20 are releasably secured to the inner surface of horizontal wall 23 of jig 22' by the magnetic attraction of magnets 24. Using magnets to secure the ends of the coils to the first jig 22' provides great versatility since the coils 20 can be easily maneuvered from one position to another and a variety of patterns of coils may be formed. In the embodiment of FIGS. 6 and 7, the coils are aligned in straight rows using the magnet means. Alternatively, the magnet means can be used to position the coils in staggered formations or any desired alignment. Positioning indicators can be provided on the interior surface of horizontal wall 23** to simplify coil placement.

In an alternate embodiment, the first jig 22 may be provided with releasable mechanical clamps at each coil position (not shown) for securing the ends **20*a* of the coils 20** so that the coils are clamped for mounting and released after the foam sets as a unit, individually and in groups.

The advantages of using magnetic force to secure the coils to the first jig, includes the flexibility of the selective positioning of the coils as desired. As noted, a pattern may be drawn on the inner surface of horizontal wall 23 of jig 22 so that not only specific positions such as staggered or row formations may be set, but the placement of coils with different gauges may also be predetermined. Since the thickness of the wire of a coil determines its ability to resist compression (degree of firmness), different gauge coils can be secured to the first jig in a predetermined pattern so that a mattress having selected degrees of firmness in different areas can be produced as desired. For example, the center region (viewed lengthwise) of a mattress may be of a greater firmness to support greater weight.

Following the releasable attachment of the first ends 20*a* of the coils 20 to the first jig 22, the horizontal wall 23 of the first jig 22 is positioned above the tray 10 containing the foamable reaction mixture 26 so that the unattached second ends 20*b* of the coil are suspended spaced from the bottom of the tray having the freshly sprayed foamable reaction mixture 26 therein. This alignment is shown in FIG. 7 using a slightly different form of first jig 22, first jig 22', as more particularly described below, but still relying on the permanent magnets 24 to releasably hold coils 20 in position. In this embodiment, the height of the side walls 25 of first jigs 22 or 22' is selected to correctly position the second free ends 20*b* of coils 20 relative to the bottom 12 of tray 10 when the side walls rest on the surface which supports tray 10. The foamable reaction mixture 26 is then allowed to rise and form a foam which embeds the second free ends 20*b* of the coils 20. The second ends 20*b* of coils 20 may be forced, in part, into the foamable reaction mixture as it rises or after it rises. This poses no problem since, at this point, the foamable reaction mixture is in a gel state and effectively grips the coil ends.

In general, a chemical reaction to produce the foam is over within 45–90 seconds depending on the foam selected. Once the foam sets, the first jig may be pulled off since the magnetic attraction between the coils and the magnet means is not strong enough to resist the holding force of the second ends 20*b* of the coil 20 embedded in first foam member 32. Alternatively if mechanical clamps were used to hold the first ends 20*a* of the coils against the horizonal wall 23 of the jig, the clamps would now be released. As used herein, the term set refers to at least a partial cure sufficient to permit adhesion of the foam to the coil ends.

Reference is now made to FIG. 8 which shows the second ends 20*b* of coils 20 embedded in the first foam member 32 after it has set. Following the rising of the foam, the foamed coils are then cured at room temperature or in a curing oven until foam member 32 can be easily removed from the tray.

In the case of a mattress, the partially foamed innerspring unit is turned over and the foam member 32, having the second coil ends 20*b* embedded within it, is subsequently mounted to a second jig so that the first ends 20*a* of the coils which were previously releasably attached to horizontal wall 23 of first jig 22 by magnetic force or clamping means, but which are now free, may, in turn, be loaded into a tray containing a foamable reaction mixture.

Figure 9:
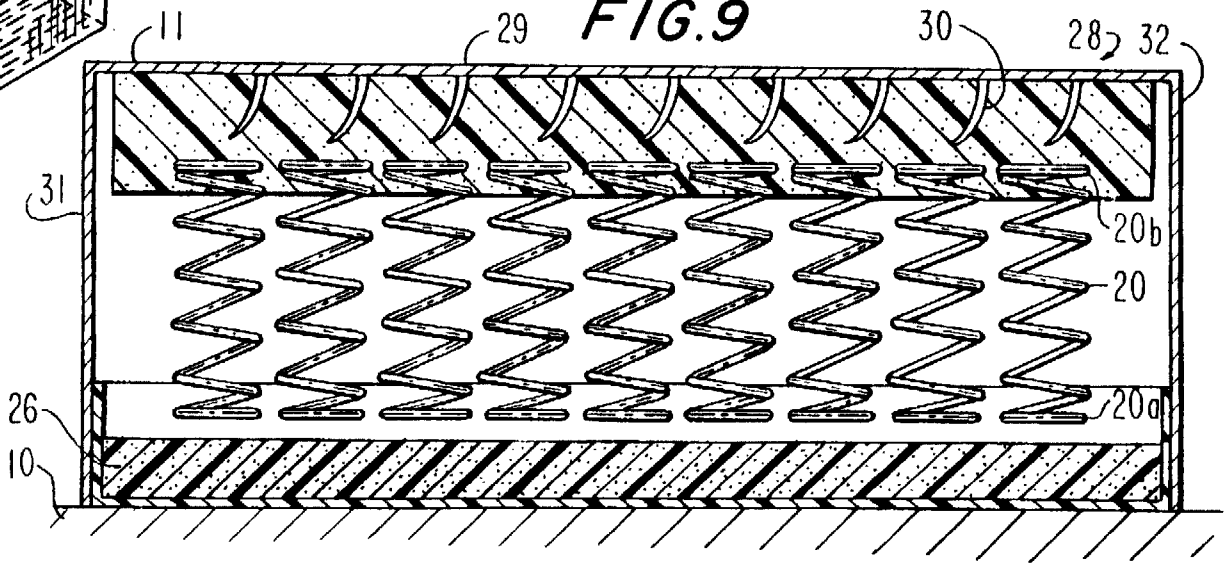
FIG. 9 is a cross-sectional view of an embodiment of a second jig supporting the partially prepared innerspring unit of FIG. 8 with the jig placed over a tray having a foamable reaction mixture therein with the free first ends of the coils above said mixture.

Reference is now made to FIG. 9 which shows a second jig 28 which is provided with curved needles 30 of a desired length welded to the inner surface of horizontal wall 29 of second jig 28. The second jig 28 also has side walls 31 extending perpendicularly from the inner surface of the horizontal wall 29. The curved needles are provided for capturing the first foam member 32 which now has the second ends 20*b* of coils 20 embedded within it. The foamed portion of the partially made mattress is mounted onto the curved needles, being centered on horizontal wall 29 through the placement of appropriate markings on the inner surface.

The horizontal wall 29 of second jig 28 is positioned over tray 10 containing the freshly sprayed foamable reaction mixture 26 so that the first ends 20*a* of the coils 20 are suspended spaced from the bottom of the tray containing sprayed foamable reaction mixture 26. The foamable reaction mixture is then permitted to rise to form a foam member 34 which captures and embeds the first ends 20*a* of the coils 20. The second jig 28 is removed (the holding force of needles 30 being insufficient to resist the holding force of the foam member 34 in tray 10) and the foam is then cured as above and removed from tray 10. The height of side walls 31 of second jig 28 is selected by positioning first ends 20*a* relative to the bottom of tray 10 as shown in FIG. 9.

Alternatively, instead of the second jig being provided with needles extending downwardly from the top surface, the second jig may have clamps (not shown) extending inwardly from the opposing side walls of second jig 28 which serve the function of grabbing and centering the foam member 32 above tray 10. In still another embodiment, tray 10 can serve as the second jig since it releasably holds the first foam member 32 until forced to release same. In such case, a suitable spacer can be provided between the two trays 10 to provide the proper positioning of coil ends 20*a*.

In another alternate embodiment, the first jig 22' of FIG. 7 is adapted to be modified to perform the function of the second jig 28 of FIG. 9 so that an entirely new second jig 28 need not be provided for the second loading step. Specifically, referring back to FIG. 7, the top surface 23 of jig 22' may be provided with longitudinal slits 23' adapted to receive a linear array of curved needles mounted on a plate (not shown) so as to extend through the slits 23' and the height of side walls 25 of the first jig 22' can be made adjustable by using a plurality of legs 27 pivotably mounted by pins 33 on the side walls 25 of first jig 22'. The legs are selectively locked in the position shown in FIG. 7 or turned 180° so as to adjust the height of side walls 25 to correspond to the height of the side walls 31 of jig 28 of FIG. 9. The locking of the legs in the two alternate positions can be by any conventional device such as spring loaded detents or clamps.

As shown in FIG. 3, the ends 20*a*, 20*b* of coils 20 of innerspring unit 30 are independently embedded within the layers of foam members 32 and 34 and adjacent coils are free of any interconnection except for the foam. The advantages of this independently embedded coil system include improving the comfort by removing the restrictions to individual coil action which results from conventional innerspring units where the coils are all bound to each other. Since each coil is free of any rigid connection to another coil, such as wires, the coils may compress independent of one another. A further advantage includes imparting greater orthopedic qualities to the mattress since, as noted above, the process allows for the placement of different gauge coils at different positions and in different patterns, allowing for a mattress to be made having a different distribution of firmness and softness. The labor, material and expense of joining coils into units before the foaming step is also avoided by the construction in accordance with the invention, also providing a relatively lighter weight mattress. Accordingly, a comfortable foamed innerspring unit 30 is prepared using a minimal amount of foam materials, labor and expense.

An experiment has confirmed the durability of a mattress produced in accordance with the invention. The mattress produced in accordance with the process of this invention and having two layers of foam with the ends of coils independently embedded within the foam, was provided with a quilted cover. The top and bottom panels of the cover were glued to foam members only around the perimeter thereof and the border material was sewn to the top and bottom panels using common edge tapes. The foamed innerspring covered with the quilted cover was then exposed to a "torture" device, a hexagonal roller that weighed 250 pounds, which was rolled in the head to foot direction over the center 36 inches of the mattress. The roller ran for seven days, 24 hours per day, for a total of 100,800 passes for the duration of the test. At the conclusion of the test, it was found that (1) none of the coils cut through the surface of the foam; (2) none of the coils came loose from the foam; and (3) the surface feel of the mattress did not change noticeably during the course of the test. Although at the sixth day, two of the coils broke at the point of their centermost convolution, they did not get through to the surface and had little effect on the total surface feel of the mattress.

Since it is desirable to provide a mattress with varying degrees of firmness, the present invention provides an efficient process for customizing a mattress to have varying degrees of firmness and softness. As described, one way in which the process of this invention allows for the formation of a mattress having varying degrees of firmness is by designing desired coil patterns and mounting the desired gauge coils on the horizontal surface of the first jig by magnet or mechanical means so that the desired gauge coils correspond with selected regions of the tray and varying degrees of firmness and softness can be provided to the head, mid-section or foot region of the mattress.

An alternate embodiment of this invention, which also provides for the manufacture of a mattress having regions of varying degrees of firmness, employs the process of this invention to make foamed innerspring unit sections which together define a mattress. Two to six sections, or more, can be provided, preferably three in the longitudinal direction of the mattress, and if the mattress is for a double, king or queen size, two side-by-side sets of three sections can be provided. Each section may have the same or different firmness from the other parts.

Previously, this result was not practical or economical due to the use of foamed innerspring units having coils which were interconnected. Use of border wires made the construction of innerspring mattress sections expensive. The present invention provides an efficient, economical process of making a mattress having three or six innerspring components, wherein the components have at least two different firmnesses. While trays and jigs dimensioned to produce sections can be provided, one third of a twin size mattress or one sixth the size of a double (full), queen or king size mattress, such an arrangement would not be as efficient in making several sections simultaneously using regularly sized trays and jigs and existing production lines. This result is achieved by placing at least two partitions into tray 10, which is then sprayed with the foamable reaction mixture 26. The first jig 22 can be provided with a pattern on the inner surface of horizontal wall 23 corresponding to the sections created by the partitions in tray 10 so that coils of a selected gauge, which consequently provide varying degrees of firmness, are loaded into each area of the jig 22 corresponding to the three sections of the tray, which were created by placing two partitions into the tray.

The coils 20 should be spaced on the inner surface of horizontal wall of the jigs to allow for appropriate placement in the corresponding sections of the tray, so that sufficient space exists between coils at the partitions. The trays with partitions can be sprayed with the foamable reaction mixture using the array of nozzles used for full mattresses and the process of the invention is carried out as disclosed. To the extent that "flashing" occurs at the partitions of the trays after spraying the trays with foam, the flashing can simply be cut away. Upon completion of the process of the invention using a tray with two partitions, three separate foamed innerspring components are formed, the three components either having the same firmness or different firmness, depending on the gauge of coil loaded into each section.

By way of example, a tray 10 may be provided with two partitions extending widthwise which would consequently divide the mattress into three equal sections, a head section, middle section and foot section. The first jig 22 can be loaded with coils 20 corresponding to the three sections of the tray created by the two partitions so that heavy gauge coils are placed in the jig to correspond to the middle section of the tray and thinner lower gauge coils are placed in the jig to correspond to the sections of the tray flanking the middle portion, the head and foot sections of the tray, respectively. Following completion of the process of the invention, a mattress having three separate foamed innerspring components is produced wherein two of the components are softer than the one component loaded with thicker coils.

In a preferred embodiment for double, king and queen size beds, the tray is provided with three partitions, two distributed widthwise in the tray and one partition extending lengthwise through the center of the tray.

Reference is now made to FIGS. 10, 11 and 12 which show a tray having six sections, which is used in conjunction with creating six foamed innerspring unit sections, and the finished mattress made in this fashion, respectively. A tray 10' having partitions 36 dividing the tray into a total of 6 sections is shown in the perspective view in FIG. 10. As shown, the tray 10' has the preferred flat bottom 12'. Coils of varying gauges can be loaded into each of the six sections of tray 10'.

FIGS. 11 and 12 show a mattress generally indicated as 38. The mattress is composed of six separate mattress sections, such as six separate foamed innerspring unit sections 41 made in accordance with this invention. The mattress is formed by placing the individual sections into compartments formed in a cover 40. The cover 40 for receiving the separate foamed innerspring unit sections 41 is provided with top and bottom cover layers 42, preferably quilted and glued at their periphery to innerspring components 41. A border 44 is joined to the top and bottom cover layers at their periphery using conventional edge defining mattress tape 45. Internal partitions 43 extend between top and bottom cover layers 42, secured to the bottom cover layer, by way of example, by glue 46 and to the cop cover layer, by of way of example, by stitching 47. A zipper 48 extends along the length of each of two sides of border 44.

The foamed innerspring components are loaded into each side of the cover 40 by unzippering one of the zippers 48 and placing each component 41 into an appropriate section. The step of gluing the top and bottom covers can be performed at this time.

A mattress having six foamed innerspring unit sections is produced, wherein the coil patterns of the sections in the head regions may be different form the coil pattern of the component in the middle regions and the firmness of the coils in the head region may be different from the firmness of the coils in the foot region. By way of example, coils 20 in one innerspring unit section of the mattress of FIG. 11 are shown in a staggered rather than an aligned pattern. As seen in FIG. 12, the coils 20' in the central section 41 are of a heavier gauge than the coils 20" of the head section 41, creating a greater degree of firmness in the center. In one possible example, the left side of the mattress can be formed of soft, firm and medium firmness sections respectively as viewed from the head, while the right side of the mattress can be formed from medium, extra firm and firm sections as viewed from the head. The result is a mattress which can accommodate a 250 lb and a 120 lb person sleeping side-by-side with full comfort and minimum mattress distortion. While degree of firmness in the embodiment of FIG. 12 is determined by coil gauge, it can also be determined by foam selection.

In a further embodiment as shown in FIG. 13, the mattress cover shown generally as 52 of mattress 50 is provided with a pair of zippers 54 and 56 each extending along the length of one-half of the border 52, 58, to permit greater access to the interior of the cover. In this embodiment, the internal partitions 60 are also divided in half, one half secured to the top cover layer and the other to the bottom cover layer. The innerspring unit sections are loaded by unzippering one side, laying in the sections, gluing and pulling the cover tight over the sections so that the partitions fall into the appropriate gap between sections.

FIG. 16 shows a further embodiment for enclosing the separate foamed innerspring unit sections within a cover means. Instead of having partitions within the cover means, this embodiment of the present invention includes a layer of foam material wrapped about the periphery of each foamed innerspring component 41'. A layer of heavy cloth can also be used for this purpose. The peripheral wrapping is glued to the sides of foam sections 32 and 34. The wrapped components are inserted into a cover 62 formed without partitions. The cover is preferably glued to the sections at its periphery. This construction permits the use of a cover without separate partitions for receiving the individual foamed innerspring components. The components wrapped in this manner would remain secure within the cover means due to the friction between the peripheral layers wrapped about the adjacently positioned innerspring components. Also, the peripheral wrapping prevents one section from being displaced vertically relative to another so that the edge of a foam member of one section enters the gap between the foam members of an adjacent section.

FIG. 16 also demonstrates still another alternate embodiment of the invention, where an open lightweight mesh 64 is laid on the free end of the coils when the jig is in the position of FIG. 6 and secured by string or other means to a number of coils sufficient to prevent the mesh from sagging when the jig is turned over to the position of FIGS. 7 and 9. The mesh can be either a woven mesh or a mesh that has been extruded and stretched in a molten state. Preferably, the mesh is formed of nylon or polypropylene. The mesh serves as an insulator. In effect, the mesh provides additional strength to the foam members 32, 34 but does not serve to hold the coils in their respective positions. That function is performed by the foam.

Figure 14:
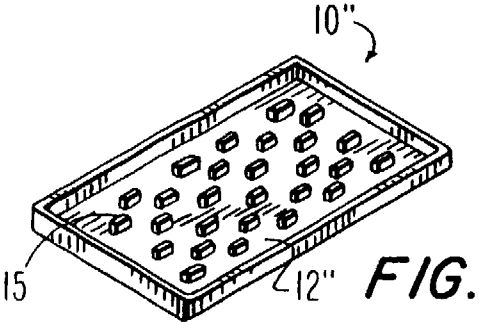
FIG. 14 is an alternate embodiment of the tray in accordance with the invention.

Referring now to FIGS. 14 and 15, an alternate embodiment of the tray 10" is depicted. In the embodiment of FIGS. 14 and 15, the bottom 12" of the tray 10" is not flat, but rather, is formed with a series of elongated notches or ridges 15 projecting into the interior of the tray. The ridges are positioned to receive the free ends **20*b* of the coils 20 held by magnetic force within jig 22. With this arrangement, the height of the side walls 25 of jig 22** becomes less critical.

The construction of the innerspring unit in accordance with the invention offers substantial advantages over the prior art innerspring unit constructions, both in reduced expense and material of production and in substantial functional advantages. Among the functional advantages is not only the provision of a mattress wherein the individual coils can function more independently than in a conventional mattress where the coils are tied together by wires or the like, but also permits production of a sectioned mattress. As pointed out above, the sectioned mattress offers flexibility in tailoring the design of a mattress to the consumer. A further possibility enabled by the sectioned construction in accordance with the invention is the possibility of selling mattresses by mail or parcel post. It is difficult to ship a full mattress by these means. It would be more practical to ship the mattress sections and a cover to the consumer with instructions as to how to assemble the mattress sections. The construction in accordance with the invention is particularly suited to produce effective mattress sections at reasonable cost.

It will thus be seen that the objects set forth above, among those made apparent, from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method for forming a foamed innerspring unit having a plurality of coils, comprising:

releasably securing a plurality of independent coils to a first jig, each coil having a first end and a second end, the coils being releasably secured to the first jig at their first ends and free at their second ends so that each coil is independently suspended from the first jig, said independent coils being otherwise free from interconnection therebetween;

delivering a first foamable reaction mixture that will provide a flexible foam into a tray to form a first layer of foamable reaction mixture of the desired thickness in the tray;

positioning the jig above the tray so that the second ends of the suspended coils are placed in spaced relation to the bottom of the tray and the first layer, of foamable reaction mixture;

allowing the first layer of foamable reaction mixture to rise to form a first foam layer which embeds the independently suspended coils at their second ends;

separating the first jig from the first ends of the coils and removing the first jig so that the independent coils are free from interconnection therebetween except for the first foam layer that embeds the second end of each independently suspended coil;

releasing the first foam layer from the tray;

releasably securing said first foam layer having the second ends of the coils embedded therein to a second jig;

delivering a foamable reaction mixture that will provide a flexible foam into a tray to form a second layer of foamable reaction mixture of the desired thickness in the tray;

positioning the second jig above the tray so that the first ends of the suspended coils are placed in spaced relation to the bottom of the tray and to the second layer of foamable reaction mixture; and allowing the second layer of foamable reaction mixture to rise to form a second foam layer which embeds the independently suspended coils at their first ends.

2. The method of claim 1, and including a first jig with a coil supporting wall and means extending from the coil supporting wall for defining the spacing between the second ends of the coils and the bottom of the tray.

3. The method of claim 1, and including releasably securing the first ends of the coils to the first jig by magnetic force.

4. The method of claim 1, and including providing the tray with a plurality of notches projecting from the bottom of the tray and extending into the interior of the tray to support the second ends of the coils.

5. The method of claim 1, wherein the foamable reaction mixture is applied by spraying and uses diphenylmethane diisocyanate and at least one polyol.

6. The method of claim 5, wherein the foamable reaction mixture provides a foam having a density of at least 2.0 $lbs/ft^3$.

7. The method of claim 5, further comprising spraying a release agent into the tray prior to spraying the foamable reaction mixture into the tray.

8. The method of claim 1, and including providing the second jig with a first foam layer supporting wall and means extending from the first foam layer supporting wall to define the spacing between the first end of the coil and the bottom of the tray.

9. The method of claim 1, and including providing the first jig with adjustable means for adjusting the spacing between the horizontal wall thereof and the bottom wall of the tray between at least two positions to define the second jig at one position of the adjustable means.

10. The method of claim 1, and including providing the tray with partitions dividing said tray, and therefore said first foam layer, into sections.

11. The method of claim 10, and including selecting the coils associated with one of said sections to be of a different firmness than the coils of another of said sections.

12. The method of claim 10, wherein said foamable reaction mixture is sprayed into the partitioned tray by relatively displacing at least one nozzle and the tray to form a layer of the desired thickness in the tray.

13. The method of claim 1, wherein said coils are selected to include coils of at least two different degrees of firmness, said coils being selectively positioned on said first jig to define an innerspring unit having regions of different degrees of firmness.

14. The method of claim 1, and including providing a layer of insulator material overlying the second ends of at least a portion of the coils for providing increased strength to the foam, before positioning the first jig relative to the tray.

15. The method of claim 1, and including providing a layer of insulator material overlying the first ends of at least a portion of the coils for providing increased strength to the foam, before positioning the second jig relative to the tray.

16. A method for forming a foamed innerspring unit having a plurality of coils, comprising:

releasably securing a plurality of independent coils to a first jig, each coil having a first end and second end, the coils being releasably secured to the first jig at their first ends and free at their second ends so that each coil is independently suspended from the first jig;

delivering a first foamable reaction mixture that will provide a flexible foam into a tray to form a layer of foamable reaction mixture of the desired thickness in the tray;

positioning the jig above the tray so that the second ends of the suspended coils are placed in spaced relation to the bottom of the tray;

allowing the first foamable reaction mixture to rise to form a first foam layer which embeds the independently suspended coils at their second ends;

separating the first jig from the first ends of the coils and removing the first jig;

releasing the first foam layer from the tray;

providing a second jig with a first foam layer supporting wall and means extending from the first foam layer supporting wall to define the spacing between the first end of the coil and the bottom of the tray and a horizontal surface and a plurality of needles extending downwardly from the horizontal surface;

releasably securing said first foam layer having the second ends of the coils embedded therein to the second jig;

delivering a second foamable reaction mixture that will provide a flexible foam into a tray to form a layer of foamable reaction mixture of the desired thickness in the tray;

positioning the second jig above the tray so that the first ends of the suspended coils are placed in spaced relation to the bottom of the tray;

allowing the foamable reaction mixture to rise to form a second foam layer which embeds the independently suspended coils at their first ends; and releasably receiving the first foam layer by said plurality of needles.

17. A method for forming a mattress comprising forming a plurality of foamed innerspring unit sections, each innerspring unit section comprising a plurality of independent coils, each coil having a first end and second end, each coil embedded at said first end in a first foam layer and at said second end in a second foamed layer by releasably securing said plurality of independent coils to a first jig, the coils being releasably secured to the first jig at their first ends and free at their second ends so that each coil is independently suspended from the first jig; delivering a foamable reaction mixture that will provide a flexible foam into a tray to form a first layer of foamable reaction mixture of the desired thickness in the tray; positioning the jig above the tray so that the second ends of the suspended coils are placed in spaced relation to the bottom of the tray and to the first layer of foamable reaction mixture; allowing the first layer of foamable reaction mixture to rise to form a first foam layer which embeds the independently suspended coils at their second ends; separating the first jig from the first ends of the coils; removing the first jig; releasing the first foam layer from the tray; releasably securing said first foam layer having the second ends of the coils embedded therein to a second jig; delivering a foamable reaction mixture that will provide a flexible foam into a tray to form a second layer of foamable reaction mixture of the desired thickness in the tray; positioning the second jig above the tray so that the first ends of the suspended coils are placed in spaced relation to the bottom of the tray and to the second layer of foamable reaction mixture; allowing the second layer of foamable reaction mixture to rise to form a second foam layer which embeds the independently suspended coils at their first ends; providing a cover dimensioned to hold a desired quantity of said foamed innerspring unit sections; and inserting the desired quantity of foamed innerspring unit sections in said cover.

18. The method for forming a mattress of claim 17 further comprising forming said innerspring units so as to be of different degrees of firmness, and selectively positioning the innerspring unit sections within said cover to define a mattress having regions of different firmnesses as determined by the positioning of the innerspring unit sections.

19. The method of claim 17, and including providing partitions formed in said cover to separate adjacent innerspring unit sections.

20. The method of claim 19, and including providing a layer of material about the periphery of each innerspring unit section for reducing relative displacement of the innerspring unit sections while in said cover.

21. The method of claim 19, said coils being selected to be of at least two degrees of firmness, and including six innerspring unit sections aligned in two side-by-side groups of three innerspring unit sections, an adjacent pair of innerspring unit sections in the lengthwise direction of the mattress and an adjacent pair of innerspring unit sections in the width direction of the mattress each including innerspring unit sections of different degrees of firmness.

22. The method of claim 17, wherein adjacent coils are free of interconnections other than said foam.

23. The method as claimed in claim 17, further including the steps of separating the second jig from at least one of the foamed innerspring units and removing the second jig.

24. The method as claimed in claim 17, and including releasably securing the coils to the first jig by magnetic force.

25. The method of claim 17, wherein the foamable reaction mixture is applied by spraying.

* * * * *